US009936791B2

(12) United States Patent
Kim et al.

(10) Patent No.: US 9,936,791 B2
(45) Date of Patent: Apr. 10, 2018

(54) COSMETIC CONTAINER PROVIDED WITH RUBBER DISCHARGE PAD

(71) Applicant: AMOREPACIFIC CORPORATION, Seoul (KR)

(72) Inventors: Junyoung Kim, Seoul (KR); Hyeran Ji, Seoul (KR); Jungsun Choi, Seoul (KR); Juho Kim, Seoul (KR)

(73) Assignee: AMOREPACIFIC CORPORATION, Cheonggyecheon-Ro, Jung-Gu, Seoul (KR)

( * ) Notice: Subject to any disclaimer, the term of this patent is extended or adjusted under 35 U.S.C. 154(b) by 0 days.

(21) Appl. No.: 15/121,752

(22) PCT Filed: Jan. 19, 2015

(86) PCT No.: PCT/KR2015/000537
§ 371 (c)(1),
(2) Date: Aug. 25, 2016

(87) PCT Pub. No.: WO2015/141937
PCT Pub. Date: Sep. 24, 2015

(65) Prior Publication Data

US 2017/0099930 A1 Apr. 13, 2017

(30) Foreign Application Priority Data

Mar. 20, 2014 (KR) ..... 10-2014-0033026

(51) Int. Cl.
*A45D 33/00* (2006.01)
*A45D 40/22* (2006.01)
(Continued)

(52) U.S. Cl.
CPC ..... *A45D 40/22* (2013.01); *A45D 33/008* (2013.01); *A45D 33/025* (2013.01); *A45D 33/24* (2013.01); *A45D 40/0075* (2013.01)

(58) Field of Classification Search
CPC .... A45D 33/006; A45D 33/025; A45D 33/06; A45D 34/00
See application file for complete search history.

(56) References Cited

U.S. PATENT DOCUMENTS 1,686,973 A * 10/1928 Kendall ..... A45D 33/006 132/293
1,922,326 A * 8/1933 Rauber ..... A45D 33/006 132/306
(Continued)

FOREIGN PATENT DOCUMENTS

EP 0528705 B1 * 12/1995 ..... A45D 33/00
KR 20-0412612 Y1 3/2006
(Continued)

OTHER PUBLICATIONS

Machine Translation of EP 0528705 B1, retreived on Jun. 25, 2017.*

*Primary Examiner* — Jennifer C Chiang
*Assistant Examiner* — Bradley Oliver
(74) *Attorney, Agent, or Firm* — Lucem, PC; Heedong Chae

(57) ABSTRACT

The present invention relates to a cosmetic container provided with a rubber discharge pad, in which: a rubber discharge pad having a plurality of discharge ports is coupled to a container body, and when the rubber discharge pad is pressed, the rubber discharge pad is pressed to the bottom of the container body by elasticity such that the content accommodated in the container body is capable of being used without residual content; and since the content accommodated in the container body is discharged through the discharge ports of the rubber discharge pad, the expansion size of the discharge ports varies according to a force of pressing the discharge pad such that a discharge quantity of the content can be adjusted.

8 Claims, 10 Drawing Sheets

(51) Int. Cl.

| | |
|---|---|
| ***A45D 33/02*** | (2006.01) |
| ***A45D 33/24*** | (2006.01) |
| ***A45D 40/00*** | (2006.01) |

(56) References Cited

U.S. PATENT DOCUMENTS

| | | | | |
|---|---|---|---|---|
| 2,737,189 | A * | 3/1956 | Morningstar | A45D 33/006 132/305 |
| 4,569,438 | A * | 2/1986 | Sheffler | A45D 40/22 206/235 |
| 6,047,710 | A * | 4/2000 | Irving | A45D 33/006 132/293 |
| 6,609,526 | B2 * | 8/2003 | Yuhara | A45D 33/006 132/307 |

FOREIGN PATENT DOCUMENTS

| | | | |
|---|---|---|---|
| KR | 20-0437581 | Y1 | 12/2007 |
| KR | 20-0463142 | Y1 | 10/2012 |
| KR | 10-1248345 | B1 | 4/2013 |

* cited by examiner

PRIOR ART

PRIOR ART

COSMETIC CONTAINER PROVIDED WITH RUBBER DISCHARGE PAD

TECHNICAL FIELD

The present invention relates to a cosmetic container provided with a rubber discharge pad, and more particularly, to a cosmetic container provided with a rubber discharge pad, in which a rubber discharge pad having a plurality of outlets is coupled to a container body, and when the rubber discharge pad is pressed, the rubber discharge pad is pressed to the bottom of the container body by elasticity such that the contents contained in the container body may be used without any residual contents; and since the contents contained in the container body are discharged through the outlets of the rubber discharge pad, the expansion sizes of the outlets vary according to pressure on the discharge pad such that a discharge quantity of the contents may be adjusted.

In addition, the embodiment relates to a cosmetic container provided with a rubber discharge pad, in which the rubber discharge pad having the outlets and a tension cap having a tension protrusion are coupled to the container body such that the tension protrusion presses a rim of the rubber discharge pad to be tense, and the tension cap is firmly coupled to the container body such that the rubber discharge pad is prevented from being separated from the container body when, the rubber discharge pad is pressed.

BACKGROUND ART

In general, cosmetics, which are used to make the face of a user look beautiful, may be classified into base cosmetics, functional cosmetics and color cosmetics according to the functions.

The color cosmetics are used to beautifully adorn the skin color of a user and make a skin defect invisible, which cannot be capped with the base cosmetics, by applying the color cosmetics to a human body such as a face or nails.

In addition, the color cosmetics may protect a skin, from pollution, dust and ultraviolet rays and correct the contour of a face to give a three-dimensional effect, so that the color cosmetics are widely used.

The color cosmetics, which cap a skin defect to make skin look smooth as described above, include a powder pact. The powder pact contains powder-type contents and is used in such a manner that the powder-type contents are applied on a cosmetic portion with a puff.

However, when the powder pact is used, the powder-type contents are scattered in use and the adhesion is deteriorated when being applied on a face.

To overcome the problems described above, there has been developed a foundation having gel-type contents. The foundation cosmetic contents are prepared by mixing a color power material with components such as binder or emulsifier, melting the mixture at a predetermined temperature and cooling the melted mixture. Then, the foundation cosmetic contents are contained in a cosmetic container such as a foundation case, so that the foundation cosmetics are produced as a complete product.

One example of a foundation container according to the related art had been disclosed in Korean Registered Utility Model No. 20-0362370. As shown in FIG. 1, a foundation container according to the related art includes an inner container 1 containing a cosmetic material and provided on an outer periphery thereof with a screw, a lower container 3 inserted into a container receiving space 2 provided in the inner container 1, an upper container having an opened lower portion to be screw-coupled to a screw thread formed on an outer periphery of the lower container 3 and provided on an upper portion thereof with a puff containing space 4 in which a puff is kept, and a lid 6 hinge-coupled to a hinge formed on one side surface of the upper container 5 to be opened or closed.

However, according to the foundation container of the related art, since the cosmetic contents contained in the upper container 5 are stuck on a puff for use after the upper container 5 is separated from the lower container 3 when makeup is applied, too much cosmetics are stuck on the puff at a time.

To solve the problem, there had been disclosed a product applied by the same applicant as the present invention in Korean Registered Patent No. 10-1159877. As shown in FIG. 2, gel-type cosmetic contents are contained in a compact container 100 while being impregnated into an impregnation member 200.

However, according to the related art, since the gel-type contents impregnated into the impregnation member 200 are stuck on a puff for use, the contents, gradually move to an upper portion of the impregnation member 200 due to gravity while being used up, the contents impregnated to a lower portion of the impregnation member 200 cannot be used.

In addition, since the contents impregnated to the impregnation member 200 are used after being stuck on a puff, it is difficult for a user to arbitrarily adjust a discharge quantity of cosmetic contents.

DISCLOSURE

Technical Problem

To solve the problems described above, an object of the present invention is to provide a cosmetic container provided with a rubber discharge pad, in which a rubber discharge pad having a plurality of outlets is coupled to a container body, and when the rubber discharge pad is pressed, the rubber discharge pad is pressed to the bottom of the container body by elasticity such that the contents contained in the container body may be used without any residual contents.

Another object of the present invention is to provide a cosmetic container provided with a rubber discharge pad, in which the contents contained in the container body are discharged through the outlets of the rubber discharge pad, such that the expansion sizes of the outlets may vary according to pressure on the discharge pad, thereby adjusting a discharge quantity of the contents.

Still another object of the present invention is to provide a cosmetic container provided with a rubber discharge pad, in which the rubber discharge pad having the outlets and a tension cap having a tension protrusion are coupled to the container body such that the tension protrusion presses a rim of the rubber discharge pad to be tense, and the tension cap is firmly coupled to the container body such that the rubber discharge pad is prevented from being separated from the container body when the rubber discharge pad is pressed.

Technical Solution

According to the present invention, there is provided a cosmetic container provided with a rubber discharge pad, which includes an outer container (10) provided, with a container body containing groove, and an outer container lid (20) hinge-coupled to the outer container (10) to be opened or closed. The cosmetic container includes:

a container body (30) contained in the outer container (10) and provided with an inner wall (32);

a container lid (40) hinge-coupled to the container body (30);

a rubber discharge pad (50) coupled to an upper end of the container body (30) and provided with an outlet (51); and a tension cap (60) for fixing the rubber discharge pad (50) to the container body (30) while pressing the rubber discharge pad (50), wherein the rubber discharge pad (50) is provided on an end thereof with an inserting part (52), the inserting part (52) is fitted with the inner wall (32) of the container body (30) to fixedly couple the rubber discharge pad (50) to the inner wall (32) of the container body (30), the tension cap (60) is provided with a tension protrusion (61) and coupled to the container body (30), and the tension protrusion (61) presses a rim of the rubber discharge pad (50) to expand the rubber discharge pad (50).

In addition, the container body (30) is provided at a side thereof with the inner wall (32) and an outer wall (33).

In addition, a fitting protrusion (34) is formed on the inner wall (32) of the container body (30).

In addition, a sealing piece (42) is formed below the container lid (40).

In addition, the outlet (51) has a size in a range of 0.01 mm to 2.2 mm.

In addition, 100 to 600 the outlets are distributed onto the rubber discharge pad (50). Preferably, the number of the outlets is in the range of 300 to 500

In addition, the cosmetic container further includes a frame (70) and the rubber discharge pad (50) is coupled between the tension cap (60) and the frame (70) such that the rubber discharge pad (50) is coupled to the container body (30).

In addition, the cosmetic container further includes impregnation member (50) formed on an inside of the container body (30).

Advantageous Effects

According to the cosmetic container provided with a rubber discharge pad of the present invention, the rubber discharge pad having a plurality of outlets is coupled to a container body to allow the rubber discharge pad to be pressed to the bottom of the container body, so that the contents contained in the container body may be used without any residual contents.

In addition, according to the cosmetic container provided with a rubber discharge pad, since the contents contained in the container body are discharged through the outlets of the rubber discharge pad, the expansion sizes of the outlets may vary according to pressure on the discharge pad, thereby adjusting a discharge quantity of the contents.

In addition, according to the cosmetic container provided with a rubber discharge pad, since the rubber discharge pad having the outlets and a tension cap having a tension protrusion are coupled to the container body such that the tension protrusion allows the rubber to be firmly coupled to the container body, the rubber discharge pad may be prevented from being separated from the container body when the rubber discharge pad is pressed.

BEST MODE

Mode for Invention

Hereinafter, a cosmetic container provided with a rubber discharge pad according to an embodiment of the present invention will be described with reference to accompanying drawings.

Figure 1:
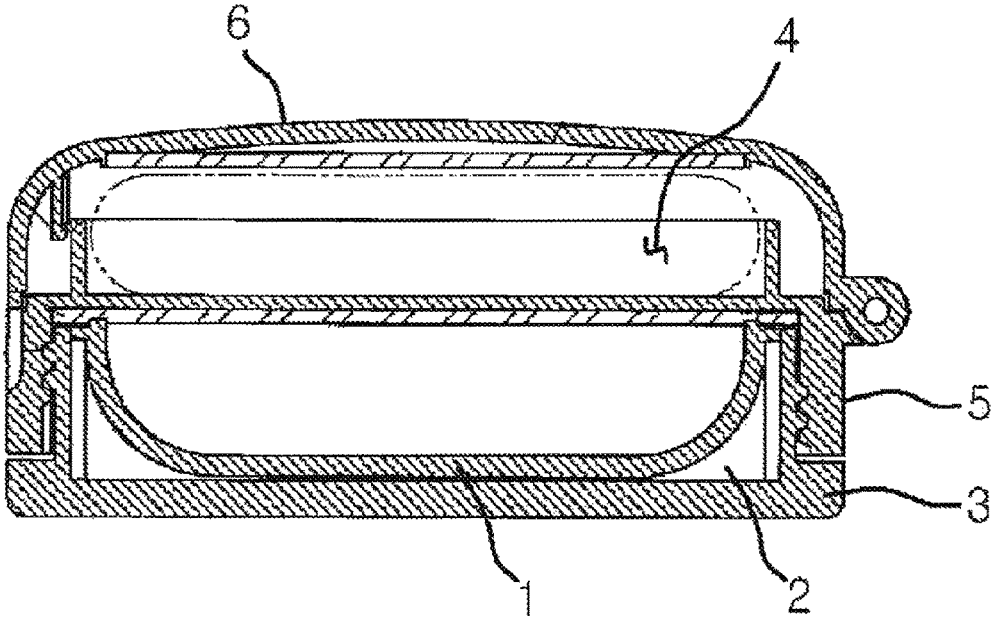
FIG. 1 is a sectional view of a foundation container according to the related art.
Figure 2:
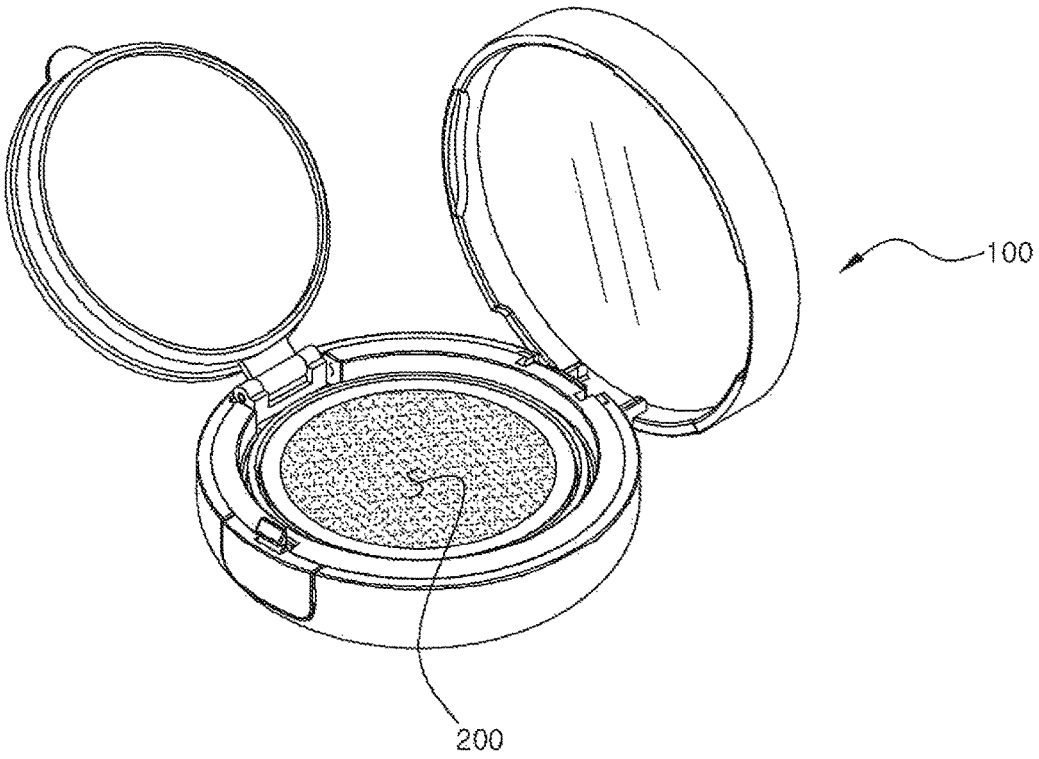
FIG. 2 is a perspective view illustrating a state that the foundation container according to the related art is opened.
Figure 3:
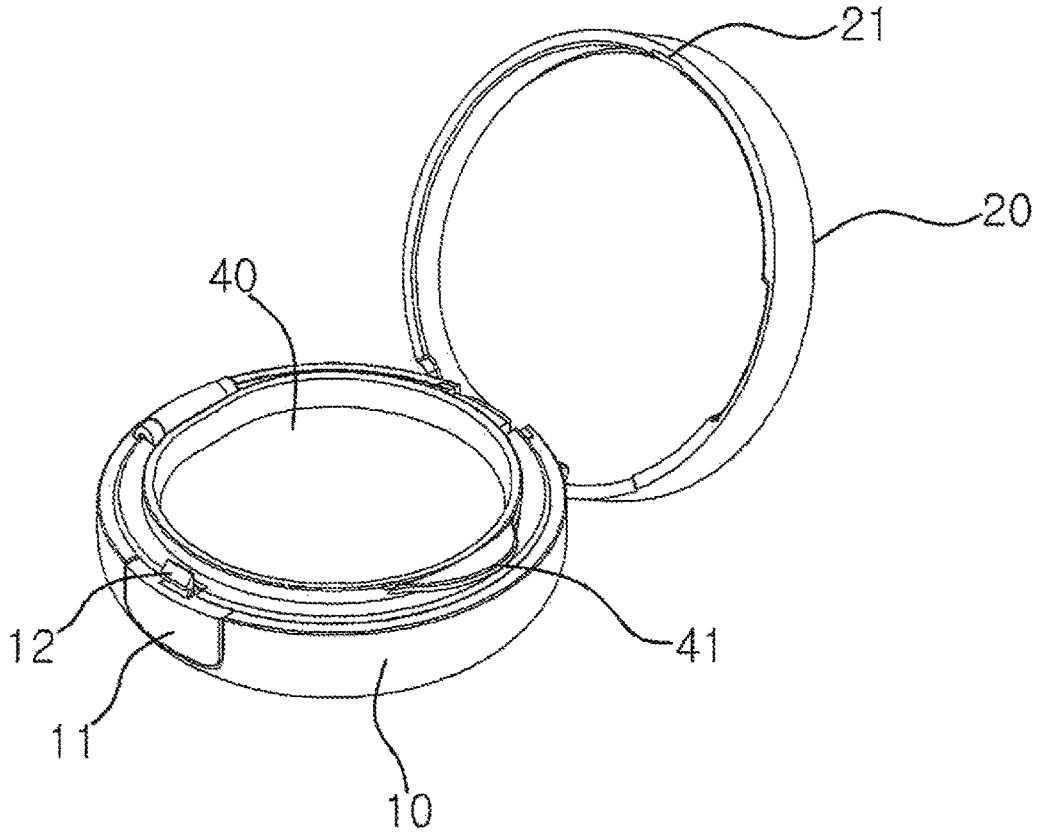
FIG. 3 is a perspective view illustrating a state that a cosmetic container provided, with a rubber discharge pad according to an embodiment of the present invention is opened.
Figure 4:
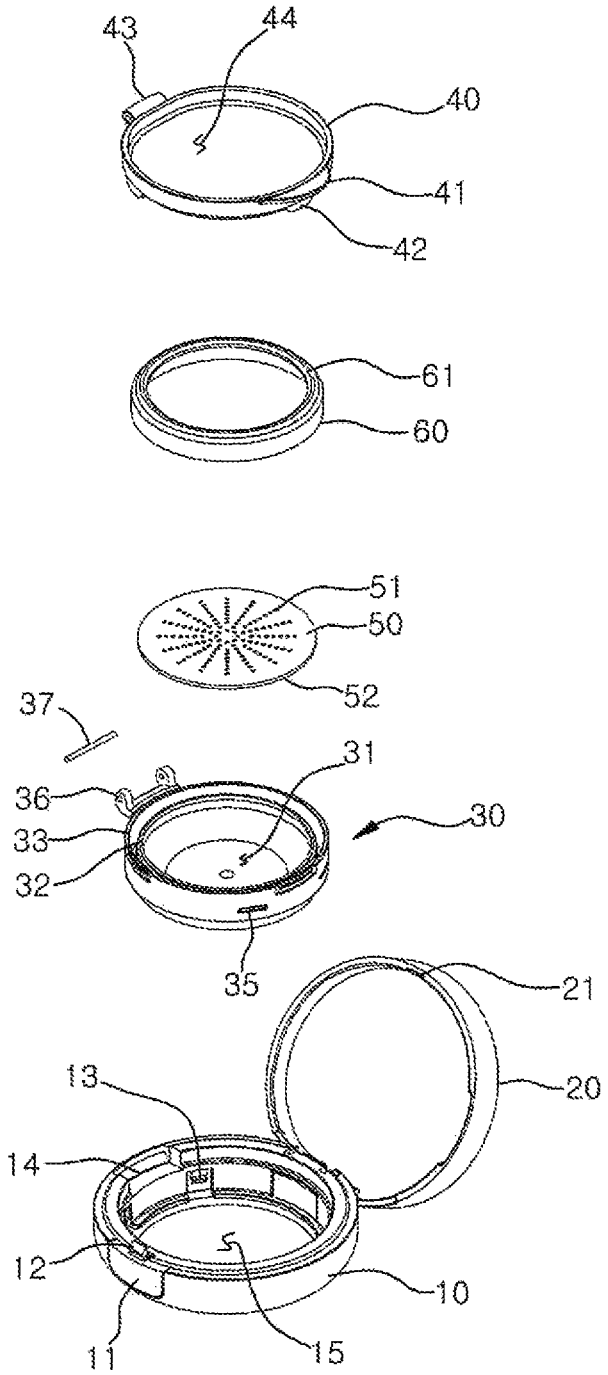
FIG. 4 is an exploded perspective view of a cosmetic container provided with a rubber discharge pad according to an embodiment of the present, invention.
Figure 5:
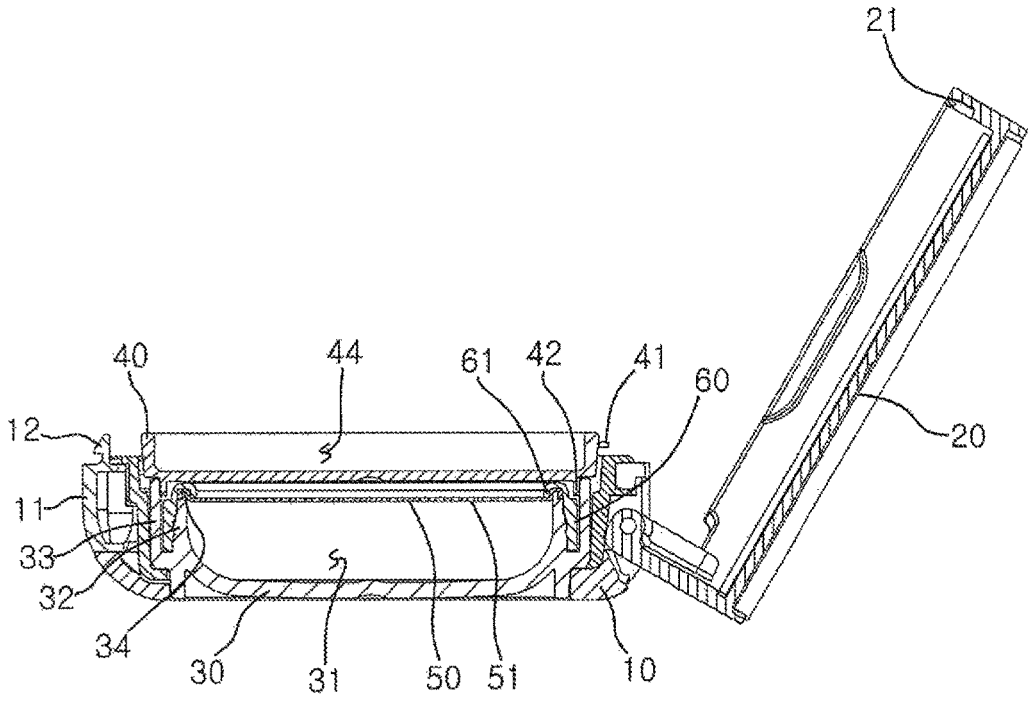
FIG. 5 is a sectional view illustrating a state that a cosmetic container provided with a rubber discharge pad according to an embodiment of the present invention is opened.
Figure 6A:
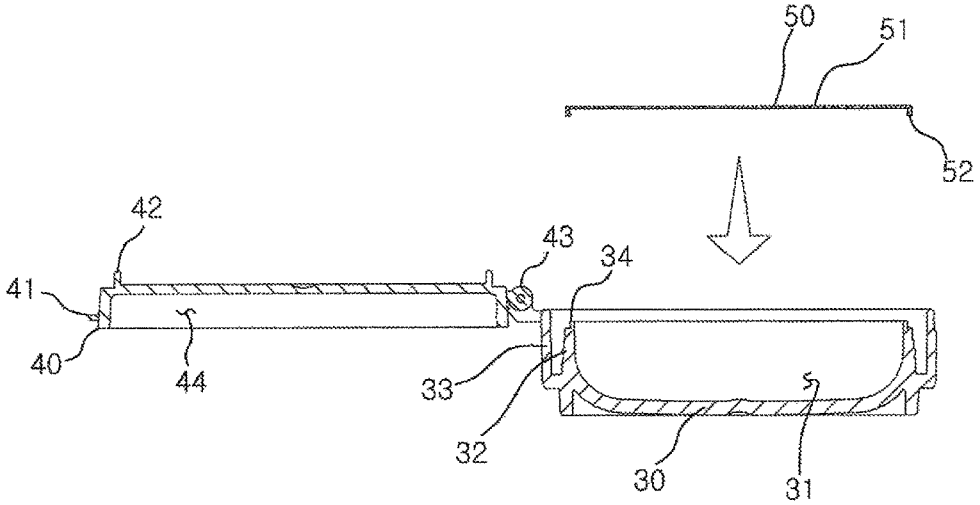
FIG. 6A is a sectional view illustrating a state that a container body of a cosmetic container provided with a rubber discharge pad according to am embodiment of the present invention is coupled to the rubber discharge pad.
Figure 6B:
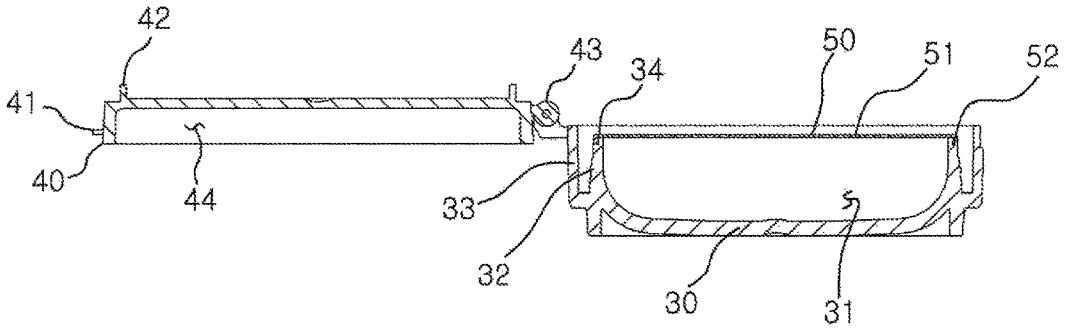
FIG. 6B is a sectional view illustrating a state that a container body of a cosmetic container provided with a rubber discharge pad according to an embodiment of the present invention, is coupled to the rubber discharge pad.
Figure 6C:
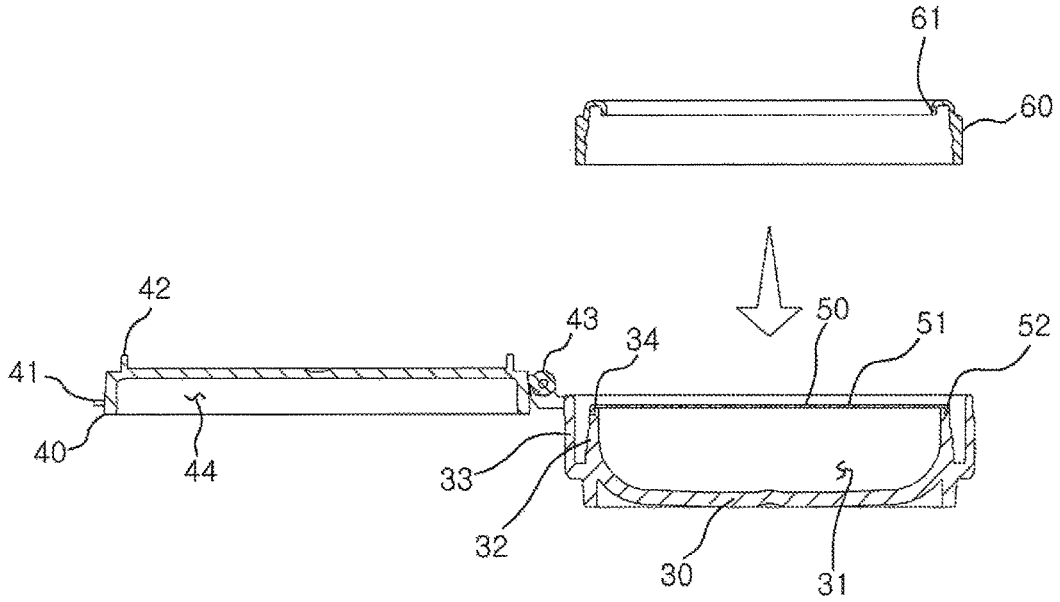
FIG. 6C is a sectional view illustrating a state that a container body of a cosmetic container provided with a rubber discharge pad according to an embodiment of the present invention is coupled to a tension cap.
Figure 6D:
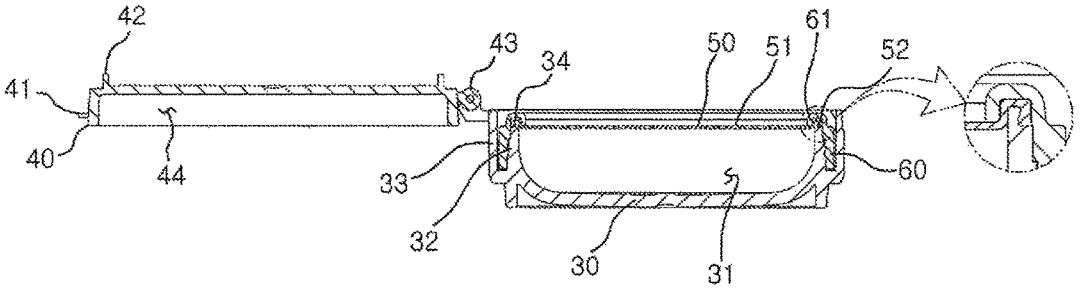
FIG. 6D is a sectional view illustrating a state that a container body of a cosmetic container provided with a rubber discharge pad according to an embodiment of the present invention is coupled to a tension cap.
Figure 7:
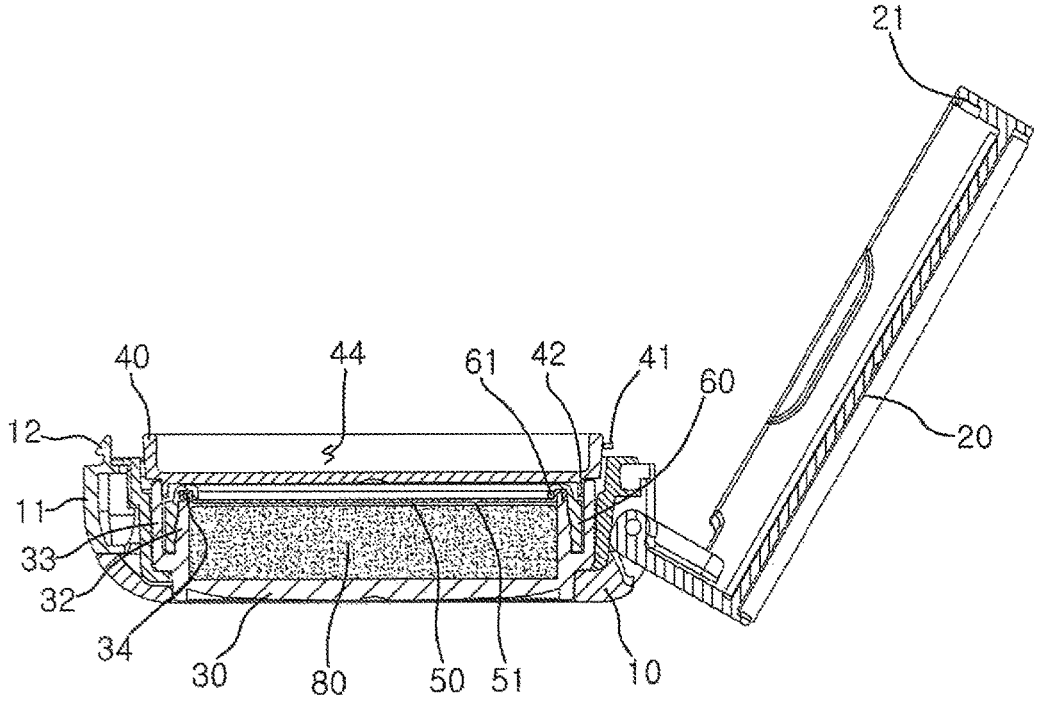
FIG. 7 is a sectional view illustrating a state that an impregnation member is opened and installed to a cosmetic container provided with a rubber discharge pad according to an embodiment of the present invention.
Figure 8A:
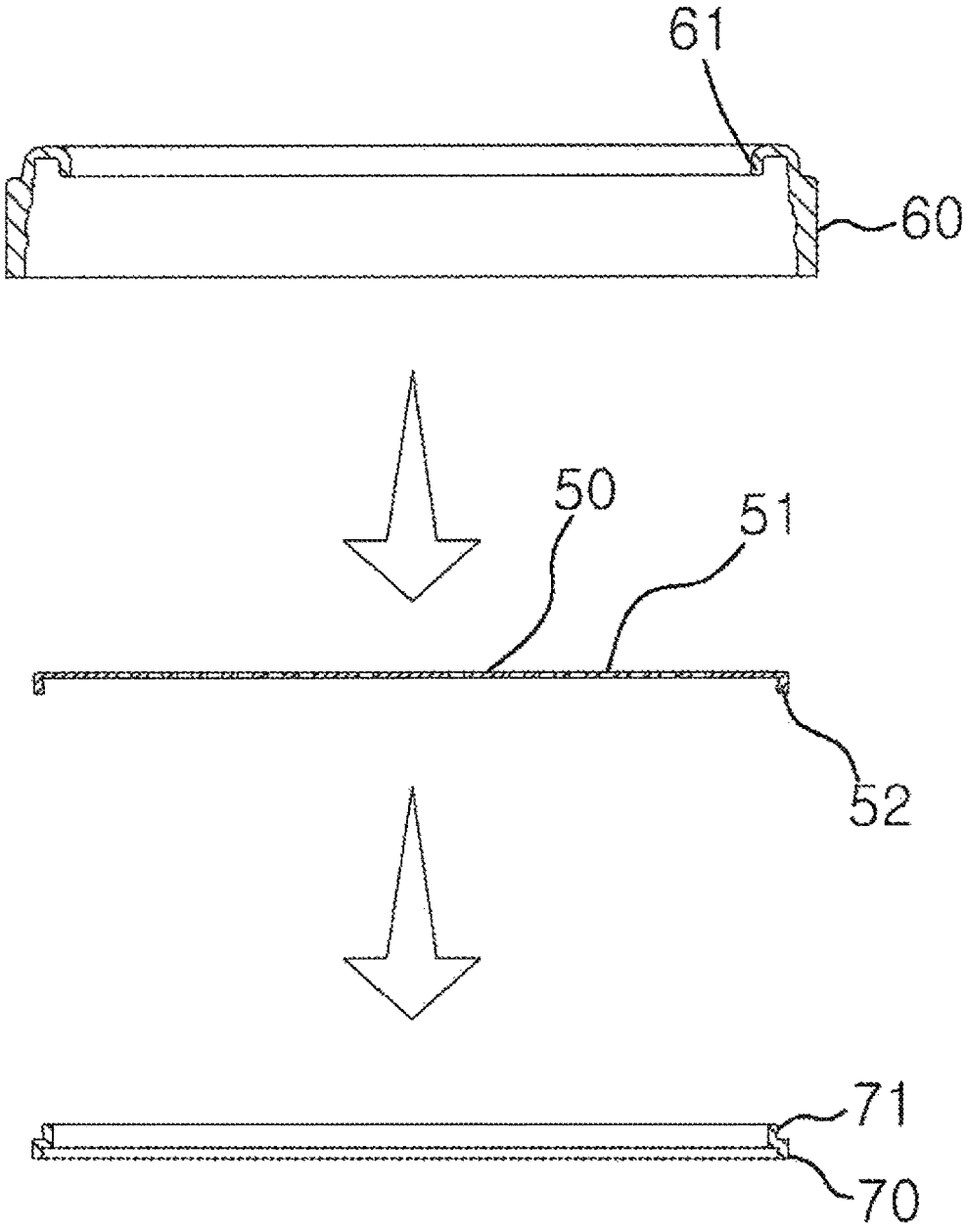
FIG. 8A is a sectional view illustrating a state that a tension cap, a rubber discharge pad and a frame of a cosmetic container provided with a rubber discharge pad according to an embodiment of the present invention are coupled to each other.
Figure 8B:
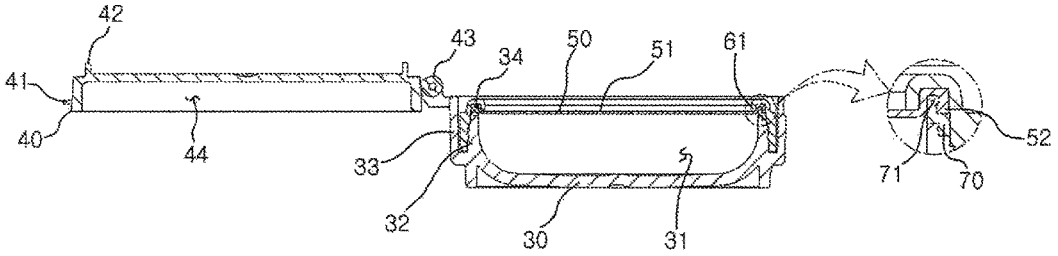
FIG. 8B is a sectional view illustrating a state that a tension cap, a rubber discharge pad and a frame of a cosmetic container provided with a rubber discharge pad according to an embodiment of the present invention coupled to a container body after being coupled to each other.
Figure 8C:
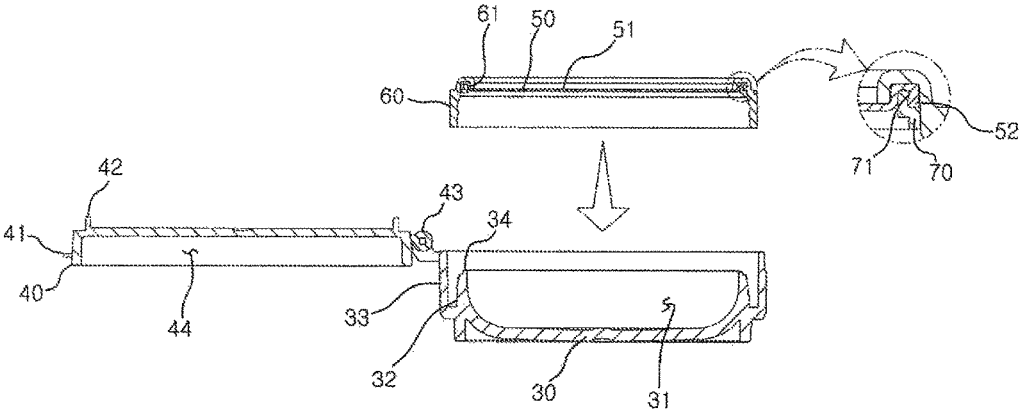
FIG. 8C is a sectional view illustrating a state that a tension cap, a rubber discharge pad and a frame of a cosmetic container provided with a rubber discharge pad according to an embodiment of the present invention coupled to a container body after being coupled to each other.

FIG. 3 is a perspective view illustrating a state that a cosmetic container provided with a rubber discharge pad according to an embodiment of the present invention is opened. FIG. 4 is an exploded perspective view of a cosmetic container provided with a rubber discharge pad according to an embodiment of the present invention. FIG. 5 is a sectional view illustrating a state that a cosmetic container provided with a rubber discharge pad according to an embodiment of the present invention is opened. FIG. 6A is a sectional view illustrating a state that a container body of a cosmetic container provided with a rubber discharge pad according to an embodiment of the present invention is coupled to the rubber discharge pad. FIG. 6B is a sectional view illustrating a state that a container body of a cosmetic container provided with a rubber discharge pad according to an embodiment of the present invention is coupled to the rubber discharge pad. FIG. 6C is a sectional view illustrating a state that a container body of a cosmetic container provided with a rubber discharge pad according to an embodiment of the present invention is coupled to a tension cap. FIG. 6D is a sectional view illustrating a state that a container body of a cosmetic container provided with a rubber discharge pad according to an embodiment of the present invention is coupled to a tension cap. FIG. 7 is a sectional view illustrating a state that an impregnation member is opened and installed to a cosmetic container provided with a rubber discharge pad according to an embodiment of the present invention. FIG. 8A is a sectional view illustrating a state that a tension cap, a rubber discharge pad and a frame of a cosmetic container provided with a rubber discharge pad according to an embodiment of the present invention are coupled to each other. FIG. 8B is a sectional view illustrating a state that a tension cap, a rubber discharge pad and a frame of a cosmetic container provided with a rubber discharge pad according to an embodiment of the present invention coupled to a container body after being coupled to each other. FIG. 8C is a sectional view illustrating a state that a tension cap, a rubber discharge pad and a frame of a cosmetic container provided with a rubber discharge pad according to an embodiment of the present invention coupled to a container body after being coupled to each other.

According to the present invention, there is provided a cosmetic container provided with a rubber discharge pad, which includes an outer container 10 provided with a container body containing groove, and an outer container lid 20 hinge-coupled to the outer container 10 to be opened or closed.

The cosmetic container includes a container body 30 contained in the outer container 10 and provided with an inner wall 32, a rubber discharge pad 50 coupled to an upper end of the container body 30 and provided with an outlet 51, and a tension cap 60 for fixing the rubber discharge pad 50 to the container body 30 while pressing the rubber discharge pad 50.

The outer container 10 includes a push button 11 formed on one side surface thereof with a locking sill 12 and a hinge formed at a side facing the push button 12, such that the outer container 10 is hinge-coupled to an outer container lid 20. The outer container 10 includes a container body containing groove 15 provided therein, a coupling protrusion 13 formed on an inner periphery surface thereof, and a hinge bracket installing groove 14 formed on an inner periphery thereof.

The push button 11 may allow the locking sill 12 extending from an upper portion of the push button 11 to easily move back according to a pushing operation by a user, such that the locking sill 12 is separated from a locking protrusion 21 of the outer lid 20.

The coupling protrusion 13 is formed on an inner periphery surface of the outer container 10 such that the coupling protrusion 13 is coupled to the container body 30.

The hinge bracket 36 of the container body 30 is installed into the hinge bracket installing groove 14 and the container body 30 is placed in the container body containing groove 15.

The outer container lid 20, which covers an upper portion of the outer container 10, is hinge-coupled to the outer container 10 to open or close the outer container 10.

The locking protrusion 21 is formed at one side of the outer container lid 20 and has a protrusion shape corresponding to the locking sill 12 of the outer container 10.

The container body 30 has a content containing space 31. The container body 30 is provided on a side surface thereof with inner and outer walls 32 and 33 and is formed on an outer periphery surface of the outer wall with the coupling groove 35.

Contents are contained, in the content containing space 31.

In addition, as shown in FIG. 7, an impregnation member 80 may be further installed into the content, containing space 31 of the container body 30.

The impregnation member may include at least one selected from the group consisting of butadiene rubber, styrene butadiene rubber, natural rubber, acrylonitrile-butadiene rubber, wet urethane, dry urethane, polyether, polyester, polyvinyl chloride, polyethylene, latex, silicon, polyvinyl alcohol, silicone agent elastomer, nitrile rubber, butyl rubber and neoprene.

A fitting protrusion 34 is formed on an upper end of the inner wall 32. As shown in FIG. 6D, the fitting protrusion 34 is fittingly coupled to a fitting part 52 of the rubber discharge pad 50.

The outer wall 33 is fitted with a sealing piece 42 of the container lid 40, such that the air-tightness of the container body 30 is enhanced.

The tension cap 60 is fittingly coupled between the inner and outer walls 32 and 33.

The coupling groove 35, which is formed on an outer periphery surface of the outer wall 33, is coupled to the coupling protrusion 13 of the outer container 10 to fix coupled when the container body 30 is contained in the container body containing groove 15 of the outer container 10.

In addition, the container body 30 is provided with the hinge bracket 36 and a hinge pin 37 such that the container body 30 is coupled to the container lid 40.

The hinge bracket 36 is formed on a side surface of the container body 30 and is installed into the hinge bracket installing groove 14, such that the hinge bracket 36 is hinge-coupled to the container lid 40 with the hinge pin 37.

An opening/closing handle 41 is formed on one side surface of the container lid 40 to easily open or close the container lid 40.

The sealing piece 42 is formed on a lower end of the container lid 40. The sealing piece 42 is inserted into the outer wall 33 of the container body 30 so that the air-tightness of the container body 30 is enhanced.

The hinge protrusion 43 is formed at one side of the container lid 40 and the hinge protrusion 43 is inserted into the hinge bracket 36 of the container body 30 such that the container lid 40 is fixed to the container body 30 with the hinge pin 37.

A puff keeping space 44 is formed on an upper surface of the container lid 40 to keep a puff (not shown) as a cosmetic tool.

The rubber discharge pad 50 is provided with the plurality of outlets 51 to allow contents to be discharged therethrough and provided on an end thereof with the fitting part 52.

The rubber discharge pad 50 is pressed to the bottom of the container body 30 by elasticity so that the contents contained in the container body 30 may be used, without any residual. Since the contents are discharged through the outlets 51 of the rubber discharge pad 50, the discharge quantity of the contents contained in the container body 30 may be adjusted according to pressure on the rubber discharge pad 50, so that the contents are prevented from being wasted.

The rubber discharge pad 50 may be formed of at least one of natural rubber, elastomer, silicon rubber, acrylonitrile-butadiene rubber, and synthetic resin having excellent elasticity.

A size of the outlet 51 is in the range of 0.01 mm to 1.2 mm. The number of outlets 51 is in the range of 100 to 600 and distributed on the rubber discharge pad 50. Preferably, the number of outlets 51 is in the range of 300 to 500.

A total of 50 women in their 20 s and 30 s have been surveyed about usability of the rubber discharge pads of following embodiments 1 to 6.

[Experiment Example 1] Usability Measurement According to Size of Outlet of Rubber Discharge Pad The usability of a consumer has been measured according to a size of an outlet of a rubber discharge pad.

TABLE 1

| | Embodiment 1 | Embodiment 2 | Embodiment 3 | Embodiment 4 | Embodiment 5 | Embodiment 6 |
|---|---|---|---|---|---|---|
| Outlet size | 0.007 mm | 0.01 mm | 0.05 mm | 0.8 mm | 1.2 mm | 1.5 mm |
| Usability score | 2.42 | 4.24 | 4.65 | 4.82 | 4.18 | 2.78 |

(1.0: Very bad, 2.0: Bad, 3.0: Normal, 4.0: Good, 5.0: Very good)

As a result of measuring consumer usability according to a size of the outlet 51 of the rubber discharge pad 50, when the size of the outlet 51 is less than 0.01 mm, the particles of contents are not smoothly discharged due to surface tension, so that the usability is bad. When, the size of the outlet 51 exceeds 1.2 mm, the contents are excessively discharged so that the customer usability is bad. Thus, the rubber discharge pad 50 cannot adjust the discharge quantity of contents.

[Experiment Example 2] Usability Measurement According to Number of Outlet of Rubber Discharge Pad To measure the usability of a consumer according to the number of outlets 51 of the rubber discharge pad 50, after when the number of the outlets 51 is less than 100, the contents are not smoothly discharged, so that the usability of a customer is bad. When the number of the outlets 51 exceeds 600, the quantity of contents is too much discharged so that the customer usability is bad. Thus, the rubber discharge pad 50 cannot adjust the discharge quantity of contents.

In addition, as shown in Table 2, when the number of the outlets 51 is in the range of 300 to 400, the discharge quantity of contents is most suitable and the usability is very excellent.

That, is, since the contents are discharged through the outlets 61 of the rubber discharge pad 50, the outlets are formed to have a size in the range of 0.01 mm to 1.2 mm. When the number of the outlets is in the range of 100 to 600, the customer usability may be excellent and the discharge quantity of contents may be suitably adjusted.

The rubber discharge pad 50 is formed on the end thereof with the fitting part 52 and the fitting 52 is fitted with the inner wall 32 of the container body 30 such that the rubber discharge pad 50 is fixedly coupled to the inner wall 32 of the container body 30.

Although the rubber discharge pad 50 is directly and fixedly coupled to the inner wall 32 of the container body 30 in an embodiment of the present invention, as shown in FIGS. 8A to 8C, the frame 70 is further included in another embodiment. After the rubber discharge pad 50 is coupled between the tension cap 60 and the frame 70, the rubber discharge pad 50 is coupled to the container body 30.

The coupling protrusion 71 is formed on the upper end of the frame 70 and the fitting part 52 of the rubber discharge pad 50 is fittingly coupled to the coupling protrusion 71.

As shown, in FIGS. 8B and 8C, after being fitted with the frame 70, when the rubber discharge pad 50 is coupled to the tension cap 60 and coupled to the fitting protrusion 34 of the inner wall 32 of the container body 30, the rubber discharge pad 50 may be coupled more firmly than that coupled without any frames 70.

In addition, when the rubber discharge pad 50 is assembled with the container body 30 after the frame 70 coupled to the rubber discharge pad 50 is coupled to the

TABLE 2

| | Embodiment 1 | Embodiment 2 | Embodiment 3 | Embodiment 4 | Embodiment 5 | Embodiment 6 |
|---|---|---|---|---|---|---|
| Number of outlets | 70 | 100 | 300 | 400 | 600 | 650 |
| Usability score | 2.36 | 4.18 | 4.85 | 4.90 | 4.24 | 2.72 |

(1.0: Very bad, 2.0: Bad, 3.0: Normal, 4.0: Good, 5.0: Very good)

As a result of measuring consumer usability according to the number of the outlets 51 of the rubber discharge pad 50, tension cap 60 in advance, the components are modularized so that the process of producing a cosmetic container having a rubber discharge pad according to the present invention is simplified and the producing speed is improved.

The tension protrusion 61 is formed on the upper surface of the tension cap 60 and the tension cap 60 is fittingly coupled between the inner and outer walls 32 and 33 of the container body 30.

As shown in FIGS. 5, 6D, 7 and 8C, the tension protrusion 61 presses a portion of a rim of the rubber discharge pad 50, such that the rubber discharge pad 50 is tightened and the tension cap 60 allows the rubber discharge pad 50 to be firmly coupled to the container body 30. Thus, when the rubber discharge pad 50 is pressed, the rubber discharge pad 50 is prevented from being separated from the container body 30.

Hereinafter, the assembling method of a cosmetic container provided with a rubber discharge pad according to an embodiment of the present invention and the state of using the same will be described in detail as follows.

According to the present invention, the container body 30 is coupled into the inside of the outer container 10 which is formed with the container body containing groove 15 and hinge-coupled to the outer container lid 20.

The container body 30 is hinge coupled to the container lid 40.

After the rubber discharge pad 50 is coupled to the upper end of the container body 30 as shown in FIGS. 6A and 6B, the container body 30 is fitted with the tension cap 60 as shown in FIGS. 6C and 6B, so that the assembly of the cosmetic container provided with a rubber discharge pad according to the present invention is completed.

In addition, the rubber discharge pad 50 is not directly coupled to the container body 30, and as shown in FIGS. 8A to 8C, the rubber discharge pad 50 is coupled to the frame 70, thereby being coupled to the container body 30.

To use the cosmetic container provided with a rubber discharge pad which is assembled according to the above-described scheme, the rubber discharge pad 50 is pressed with a puff.

When the rubber discharge pad 50 is pressed, the rubber discharge pad 50 is pressed downwardly of the container body 30, so that the contents contained in the container body 30 may be used without any residual.

In addition, since the contents contained in the container body 30 are discharged through the outlets 51 of the rubber discharge pad 50, the expansion sizes of the outlets 51 are changed as the rubber discharge pad 50 is pressed, so that the discharge quantity of contents may be adjusted.

As shown in FIGS. 5, 6D, 7 and 8C, the tension protrusion 61 of the tension cap 60 presses the rim portion of the rubber discharge pad 50 so that the rubber discharge pad 50 is expanded. In addition, the tension cap 60 allows the rubber discharge pad 50 to be firmly coupled to the container body 30, so that the rubber discharge pad 50 may be prevented from being separated from the container body 30 when a user uses the cosmetic container according to the present invention.

As shown in FIG. 7, the impregnation member 80 may be further included in the container body 30. When a low-viscosity water-in-oil product according to the related art is kept in the container for a long time during circulation, the aqueous materials of internal phase and the oil materials of external phase tray be separated from each other. However, when the contents are impregnated into the impregnation member 80, the contents are contained in a small cell of the impregnation member 80 of a sponge type, the contents are prevented from being divided into the aqueous and oil materials due to surface tension in the cell.

As described above, the cosmetic container provided with a rubber discharge pad described in this disclosure is an illustrative purpose only, and the present invention is not limited thereto. Thus, it should be understood that numerous other modifications and embodiments can be devised by those skilled in the art within the spirit and scope of the present invention, and they will fall within the scope of the present invention.

DESCRIPTION OF REFERENCE NUMERAL

10: Outer container
11: Push button
12: Latching sill
13: Coupling protrusion
14: Hinge bracket installing groove
15: Container body containing groove
20: Outer container lid
21: Locking protrusion
30: Container body
31: Content containing space
32: Inner wall
33: Outer wall
34: Fitting protrusion
35: Coupling groove
36: Hinge bracket
37: Hinge pin
40: Container lid
41: Opening/closing handle
42: Sealing piece
43: Hinge protrusion
44: Puff keeping space
50: Rubber discharge pad
51: Outlet
52: Fitting part
60: Tension cap
61: Tension protrusion
70: Frame
71: Coupling protrusion
80: Impregnation member

The invention claimed is:

1. A cosmetic container provided with a rubber discharge pad, which includes an outer container (10) provided with a container body containing groove (15), and an outer container lid (20) hinge-coupled to the outer container (10) to be opened or closed, the cosmetic container comprising:

a container body (30) contained in the outer container (10) and provided with an inner wall (32);

a frame (70) coupled to an upper end of the container body (30);

a rubber discharge pad (50) provided with an outlet (51); and a tension cap (60) coupled to the rubber discharge pad (50) and the frame (70), wherein the rubber discharge pad (60) is coupled between an upper end of the frame (70) and the tension cap (60), the rubber discharge pad (50) is provided on an end thereof with an inserting part (52), the inserting part (52) is fitted with a coupling protrusion (71) of the frame (70) to fixedly couple the frame (70) to a fitting protrusion (34) of the inner wall (32) of the container body (30), the tension cap (60) is provided with a tension protrusion (61) and coupled to the container body (30), and the tension protrusion (61) presses a rim of the rubber discharge pad (50) to expand the rubber discharge pad (50), the rubber discharge pad (50) is coupled to the fitting protrusion (34) of the inner wall (32) of the container body (30), after being fitted with the frame (70) and coupled to the tension cap (60).

2. The cosmetic container of claim 1, further comprising a container lid (40) hinge-coupled to the container body (30).

3. The cosmetic container of claim 1, further comprising an outer wall (33) formed on a side surface of the inner wall (32) of the container body (30).

4. The cosmetic container of claim 1, further comprising an impregnation member (80) mounted on an inside of the container body (30).

5. The cosmetic container of claim 4, wherein the impregnation member (80) includes at least one selected from the group consisting of butadiene rubber, styrene butadiene rubber, natural rubber, acrylonitrile-butadiene rubber, wet urethane, dry urethane, polyether, polyester, polyvinyl chloride, polyethylene, latex, silicon, polyvinyl alcohol, silicone, agent elastomer, nitrile rubber, butyl rubber and neoprene.

6. The cosmetic container of claim 1, wherein a sealing piece (42) is formed below a container lid (40).

7. The cosmetic container of claim 1, wherein the outlet (51) has a size in a range of 0.01 mm to 1.2 mm.

8. The cosmetic container of claim 1, wherein 100 to 600 outlets (51) are distributed onto the rubber discharge pad (50).

* * * * *